US005785306A

United States Patent [19]

Wilson et al.

[11] Patent Number: 5,785,306

[45] Date of Patent: Jul. 28, 1998

[54] APPARATUS FOR USE IN INSTALLING SUSPENDED CEILINGS

[76] Inventors: Earnest L. Wilson, 5275 Greentree Rd., Lebanon, Ohio 45036; Robert A. Bailey, 6690 Hans Brinker Dr., Middletown, Ohio 45044

[21] Appl. No.: 722,535

[22] Filed: Sep. 27, 1996

[51] Int. Cl.[6] ..... B23P 19/00

[52] U.S. Cl. ..... 269/41; 269/46; 269/904

[58] Field of Search ..... 248/228.6, 317; 211/113; 269/41, 43, 904, 46

[56] References Cited

U.S. PATENT DOCUMENTS

| | | | |
|---|---|---|---|
| 2,524,916 | 10/1950 | Loos | 269/46 |
| 2,567,586 | 9/1951 | Werder | 269/43 |
| 3,411,735 | 11/1968 | Hurd | 211/113 |
| 3,767,008 | 10/1973 | LeBlanc et al. . | |
| 4,132,396 | 1/1979 | Graham | 269/41 |
| 4,270,721 | 6/1981 | Mainor | 248/228.6 |
| 4,836,517 | 6/1989 | Vossler | 269/41 |
| 5,148,605 | 9/1992 | Julia | 269/43 |
| 5,388,813 | 2/1995 | Arsenault . | |
| 5,611,189 | 3/1997 | Fleck | 269/41 |

*Primary Examiner*—Robert C. Watson
*Attorney, Agent, or Firm*—Jerrold J. Litzinger

[57] ABSTRACT

An apparatus for use in installing the framework for supporting a suspended ceiling having a pair of parallel legs for supporting a section of gridwork and a clamp for attaching the apparatus to a ceiling joist. The apparatus includes a plurality of grid supporting positions as well as level indicating means to accurately position the suspended ceiling supports.

5 Claims, 2 Drawing Sheets

APPARATUS FOR USE IN INSTALLING SUSPENDED CEILINGS

BACKGROUND OF THE INVENTION

1. Field of the Invention

The present invention relates generally to construction aids, and, more particularly, to an apparatus for facilitating the installation of suspended ceilings.

2. Description of the Prior Art

The use of suspended ceilings has increased significantly in the construction industry in recent years. Ceilings of this type are very cost effective, as they provide a simple way to conceal many of the necessary building materials, such as pipes, wires, etc., from plain sight in a room, while allowing easy access for maintenance purposes.

The erection of a suspended ceiling requires the installation of a metal framework grid in which the individual ceiling tiles are positioned. This grid, which uses a series of inverted T-bars which interlock to form rectangular openings configured to hold the ceiling panels, must be carefully installed before the tiles can be inserted in place. Installation of this frame can be a tedious process, as it is usually affixed in some manner to the ceiling joints or other appropriate overhead structure, and requires careful and accurate positioning over the entire area of the room in which the suspended ceiling is to be hung.

U.S. Pat. No. 3,767,008, which issued on Oct. 23, 1973, to LeBlanc et al., describes a suspension ceiling erection method and a support assembly employed therein. The assembly includes a mobile scaffold having several vertically extending sleeves which support an I-beam. The assembly is moved along in the room and adjusted to the desired position to install the metal framework. It states that using this device effects a considerable increase in the efficiency and speed with which suspended ceiling installations may be made.

Although the device taught in the LeBlanc et al. patent does improve on the manner in which suspended ceilings were previously installed, the device is very large and bulky, and requires considerable assembly and disassembly for use. In addition, it requires such space for storage between uses.

SUMMARY OF THE INVENTION

It is therefore an object of the present invention to provide a novel apparatus for use in installing suspended ceilings which is small in size, lightweight, and very simple to use.

It is also an object of the present invention to provide an apparatus which has minimal moving parts and can be easily installed.

It is a further object of the present invention to provide a device by which a person can easily install a suspended ceiling by himself.

These and other objects of the present invention are accomplished by a novel apparatus comprising a pair of spaced apart parallel members each of which contain a groove which are aligned, and attachment means for easy mounting to a ceiling beam, whereby a section of framework grid can be inserted into the grooves while it is fastened in the proper position.

DETAILED DESCRIPTION OF THE PREFERRED EMBODIMENT

Figure 1:
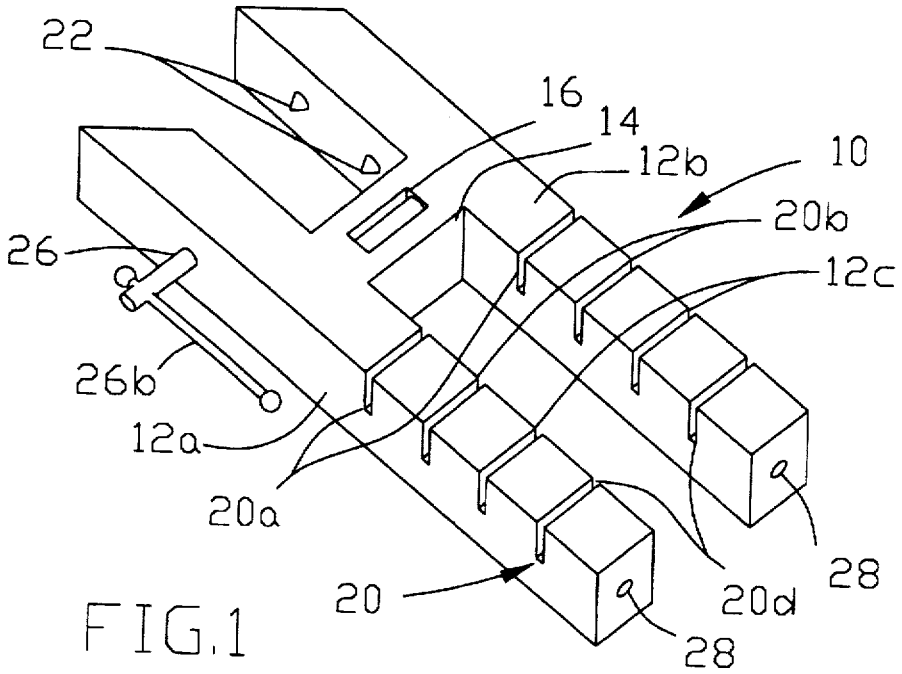
FIG. 1 is a perspective view of the apparatus of the present invention.
Figure 2:
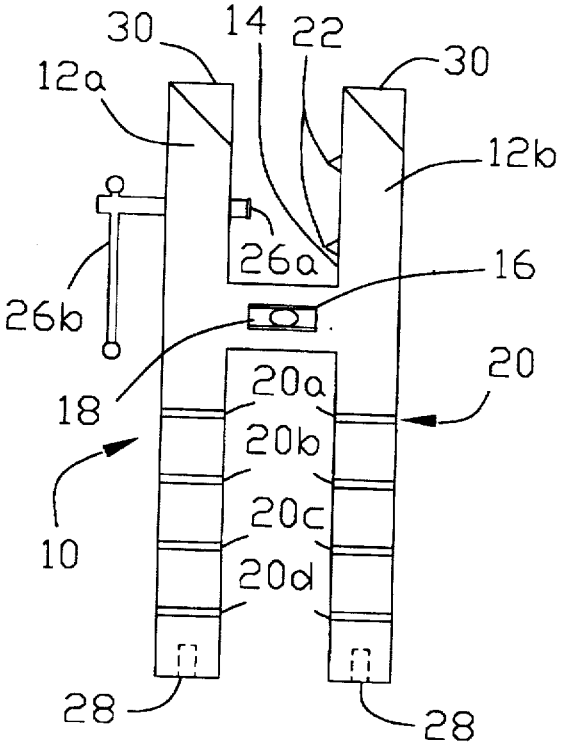
FIG. 2 is a front elevational view of the apparatus of FIG. 1.
Figure 3:
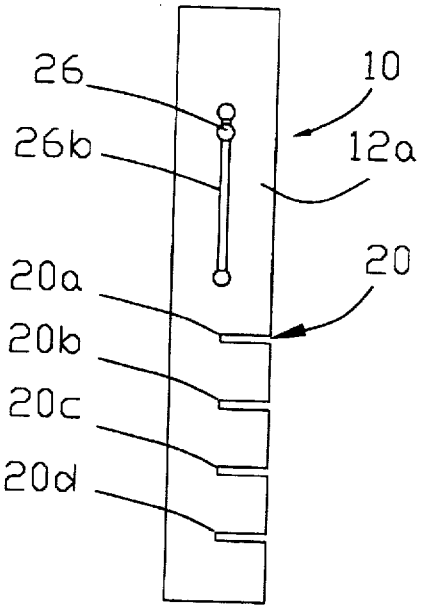
FIG. 3 is a side elevational view of the apparatus of FIG. 1.

Referring now to FIGS. 1–3, there is shown a device for assisting in the installation of suspended ceilings, generally indicated at 10. Device 10 is preferably an H-shaped apparatus which consists of a pair of essentially parallel arms 12*a* and 12*b* which are connected by a section 14 which is located between, and perpendicular to, parallel arms 12*a* and 12*b*. Section 14 may contain an aperture 16 which is formed through section 14. Aperture 16 is sized such that a level indicating means 18, such as a bubble level, can be positioned within aperture 16. Ideally, level indicating means 18 can be viewed from either side of device 10.

At one end of device 10, arms 12*a* and 12*b* contains a series of grooves, generally indicated at 20. Grooves 20 are shown in the present embodiment as a series of groove pairs 20*a*, 20*b*, 20*c*, and 20*d*. As can be seen most clearly in FIG. 2, the grooves in pair 20*a* are aligned with each other; this is also shown for pairs 20*b*, 20*c*, and 20*d*. In the present embodiment, grooves 20 are spaced at one-inch intervals. The purpose of grooves 20 will be apparent hereinafter.

On the inside wall of arm 12*b* at the end opposite grooves 20 are formed several raised protrusions 22, while at the end of arm 12*a* opposite grooves 20 there is a threaded aperture 24. A clamp 26 is threadingly engaged within aperture 24 such that surface 26*a* of clamp 26 travels between arms 12*a* and 12*b*. Clamp 26 also contains a T-handle 26*b* for ease of operation.

Finally, arms 12*a* and 12*b* are each provided with an axial bore 28 at the end containing grooves 20, while at the opposite end, arms 12*a* and 12*b* terminate at an approximate 45 degree angle to the axis of arms 12*a* and 12*b* (as is best seen in FIG. 2), creating an angular surface 30 on each arm. Bores 28 could be used to attach another device 10 to the bottom of the first by the use of dowels or similar means, thus providing an additional set of grooves 20 if the ceiling is to be suspended at a lower height than possible using device 10.

Figure 4:
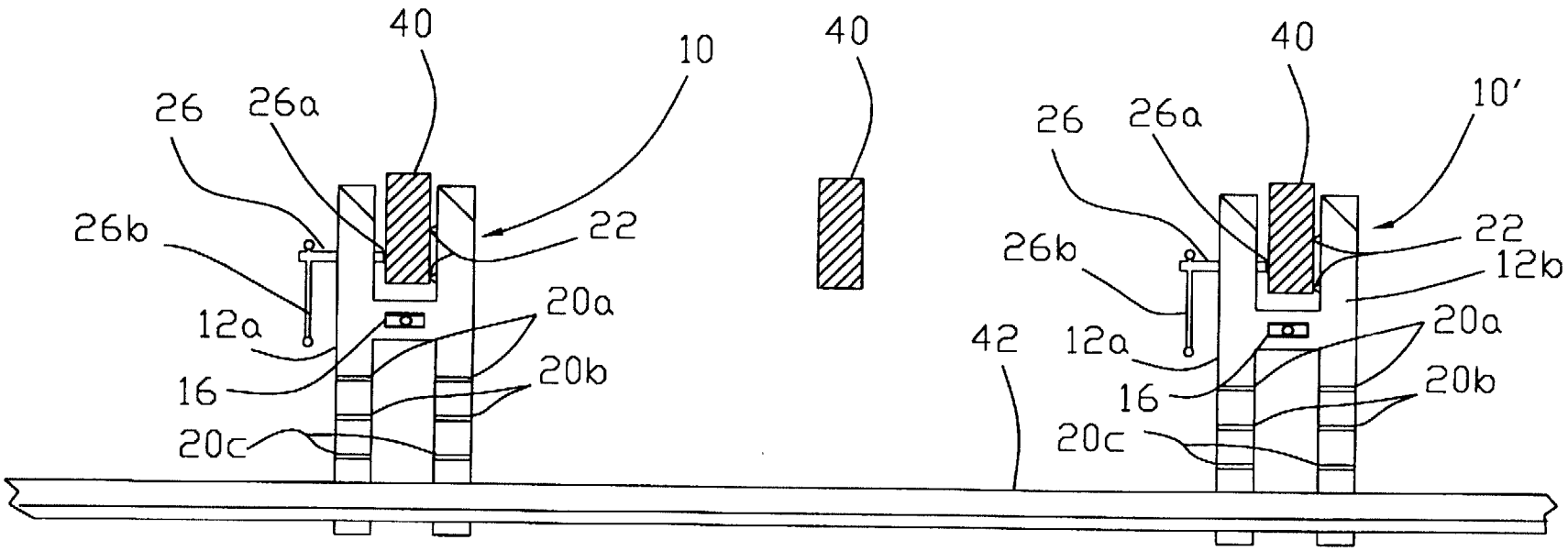
FIG. 4 is a front elevational view of the apparatus of FIG. 1 being used to aid in the installation of the gridwork used to support a suspended ceiling.

FIG. 4 illustrates the use of device 10 in the installation of the framework for use in hanging a suspended ceiling. Device 10 is secured to a ceiling joist 40 by locating joist 40 between arms 12*a* and 12*b* and adjusting clamp 26 by turning T-handle 26*b* until joist 40 is firmly held between surface 26*a* and protrusions 22. A piece of gridwork 42, which is in the shape of an inverted T, is positioned firmly within one of the pairs of grooves 20*a*, 20*b*, 20*c*, or 20*d* located on arms 12*a* and 12*b*. Device 10 can also be used to install L-shaped angle iron gridwork which is used along the walls when installing a suspended ceiling. Depending on the length of gridwork 42, it may be helpful to use a second device 10 attached to another joist 40 at some distance away from device 10 along the length of gridwork piece 42. Gridwork piece 42 can then be accurately located at the proper distance from the floor by adjusting the position of device 10 using clamp 26, or by using a different set of grooves 20. When the proper distance is located, gridpiece 40 can be adjusted for levelness by observing level indicating means 16, and then clamp 26 retightened. Piece 40 can then be permanently fastened in place using any conventional means. This process is then repeated until the complete framework for supporting the suspended ceiling is installed.

There are many advantages to using the novel device of the present invention. First, this device makes it possible for a single person to easily install a suspended ceiling by himself. Also, as the device has a series of parallel grooves for supporting the gridwork, there is greater flexibility in the positioning of the gridwork. Finally, the angled ends of the device may be used as a convenient guide for the miter cutting of inside and outside angles for the exterior walls during the installation.

While this invention has been shown and described in terms of a preferred embodiment thereof, it will be understood that this invention is not limited to this particular embodiment and that many changes and modifications may be made without departing from the true spirit and scope of the invention as defined in the appended claims.

What is claimed is:

1. A device to assist in installing sections of gridwork used to support a suspended ceiling from ceiling joists, said device comprising:

a first vertically extending member having a plurality of parallel grooves for holding a section of gridwork;

a second vertically extending member having a plurality of parallel grooves for holding a section of gridwork;

a third member rigidly affixed between said first member and said second member to secure said first and second members in an essentially parallel relationship with the parallel grooves of said first and second members in alignment, and at a fixed distance between said first and second members to form a channel for receiving a ceiling joist;

and means, adjustably fixed to said first and second members, to secure a ceiling joist within said channel;

whereby said device can be removably affixed to a ceiling joist and a section of gridwork inserted into aligned grooves within said first and second members such that gridwork can be positioned to support a suspended ceiling.

2. The device of claim 1, wherein said parallel grooves are spaced apart at one inch intervals.

3. The device of claim 1, wherein said third member contains means for indicating the levelness of the device.

4. The device of claim 3, wherein said indicating means comprises a bubble level.

5. The device of claim 1, wherein said securing means consists of a clamp threadingly engaged within said first member and a plurality of raised protrusions on said second member.

* * * * *